United States Patent [19]

Olander

[11] 4,057,172

[45] Nov. 8, 1977

[54] APPARATUS FOR DISPENSING GOLF BALLS

[75] Inventor: Harvey F. Olander, Corpus Christi, Tex.

[73] Assignee: Gustafson Mfg. Co., Corpus Christi, Tex.

[21] Appl. No.: 709,725

[22] Filed: July 29, 1976

[51] Int. Cl.[2] ..... B65H 33/14

[52] U.S. Cl. ..... 221/10; 221/260; 221/225

[58] Field of Search ..... 221/2, 7, , 13, 10, 221/260, 225, 236, 265, 266, 254, 175, 182, 259; 235/98, 92 V, 92 PC; 198/723

[56] References Cited

U.S. PATENT DOCUMENTS

| | | | |
|---|---|---|---|
| 3,311,261 | 3/1967 | Venzke | 221/254 X |
| 3,733,633 | 5/1973 | Gustafson | 15/21 A |

*Primary Examiner*—Stanley H. Tollberg
*Attorney, Agent, or Firm*—Stevens, Davis, Miller & Mosher

[57] ABSTRACT

An apparatus for dispensing a predetermined number of golf balls has a hopper for storing golf balls, a receptacle for retaining the predetermined number of golf balls in position for dispensing, and a structure for guiding and conveying the golf balls from the hopper to the receptacle. Such structure includes a passageway and a wheel having a resilient outer circumferential surface defined by a plurality of substantially radially extending bristles thereon. The receptacle has an openable and closable gate at one end thereof through which the predetermined number of golf balls therein are dispensed. Structure is also provided for rotating the wheel to fill the receptacle until the predetermined number of golf balls are filled therein after the gate is closed after discharge of the golf balls therefrom.

19 Claims, 4 Drawing Figures

APPARATUS FOR DISPENSING GOLF BALLS

This invention relates generally to apparatus for dispensing golf balls and more particularly to an improved apparatus for dispensing a predetermined number of golf balls when desired.

Practice driving ranges, as is well known, require a large numbers of golf balls, Conventionally, the driven balls are allowed to lie on the range until a very large number of them must be gathered for collection and subsequent reuse. The subsequent dispensing of the golf balls for use on driving ranges, if done manually, requires a substantial amount of both time and labor. Usually, a predetermined quantity of balls are rented by the basket or bucket which is filled by hand to some predetermined level. The number of balls in a particular basket or bucket will therefore generally vary since they are usually filled by hand without an effort being made to determine an accurate count of the balls in the basket or bucket. For the convenience of both the driving range operator and user, it is apparent that it is desirable that the number of balls in each bucket or basket be as accurate as possible.

It is an object of this invention to provide an improved apparatus for dispensing golf balls. It is a further object of this invention to provide an apparatus for dispensing a predetermined number of golf balls. It is yet another object of this invention to provide an apparatus for dispensing golf balls which does not require an operator to manually dispense the golf balls or to count the number of balls dispensed.

Other objects will become apparent from the following description with reference to the accompanying drawing wherein.

The foregoing objects and others are accomplished in accordance with this invention, generally speaking, by providing an apparatus for dispensing a predetermined number of golf balls having a hopper for storing golf balls, a receptacle for retaining predetermined number of golf balls for dispensing, and means for guiding and conveying the golf balls from the hopper to the receptacle. The guiding and conveying means comprises a channel-shaped passageway, one end of which is adjacent the hopper and the other end of which is adjacent the receptacle, and a rotatable wheel having a resilient outer circumferential surface defined by plurality of substantially radially extending bristles thereon. The passageway includes a substantially semi-circular portion concentric to the circumferential periphery of the wheel and having a bottom spaced radially outwardly therefrom by a distance slightly less than the diameter of a golf ball. Means are also provided for rotating the wheel for refilling the receptacle after a gate on the end of the receptacle is closed after discharge of balls therefrom until a predetermined number of golf balls again fill the receptacle. As a result of the invention, a predetermined number of golf balls can be dispensed whenever desired without requiring an operator to manually dispense the golf balls or to count the numbers of balls to be dispensed.

Figure 1:
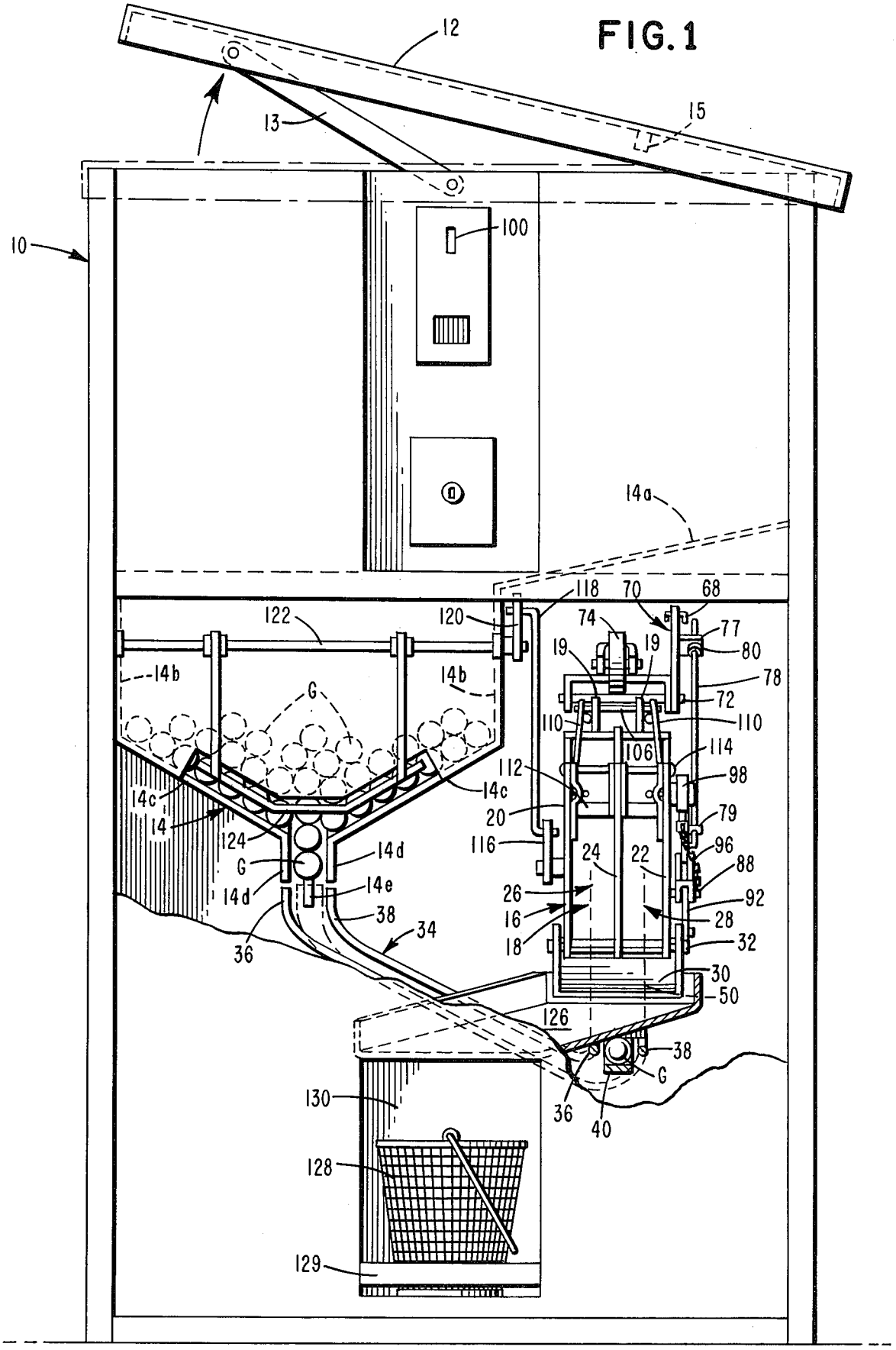
FIG. 1 is an end view, with some parts broken away and some parts in section for the purpose of clarity.

With reference to FIG. 1, shown therein is a housing 10 having four side walls and a bottom. The housing also includes a pivotable hood 12 on the top thereof which can be lifted for dumping a supply of golf balls into a hopper 14 to be subsequently described. The hood 12 is hinged to the walls of the housing 10 by a pair of straps 13. Upon opening, the rear end of the hood 12 slides on the top of the housing 10 until a stop 15 contacts one wall of the housing 10.

Fixedly secured to and disposed within the housing 10 is the hopper 14 in which a plurality of golf balls G may be dumped and stored. The hopper 14 is defined in part by the four walls of the housing 10 and includes a first sloping side surface 14*a*, a pair of vertical side walls 14*b*, a pair of sloping side surfaces 14*c*, and short vertical walls 14*d* extending from the lower edges of the surfaces 14*c*. A guide bar 14*e*, which may be secured by brackets to the housing 10, is positioned substantially between and below the walls 14*d* and defines with them a channel for guiding the golf balls G toward a passageway 34 to be subsequently described. The surfaces 14*c*, the walls 14*d* and the bar 14*e* all slope downwardly in a direction toward the passageway 34 so that golf balls G stored in the hopper 14 may gravitate theretoward. Also, because of the spacing between the bar 14*e* and the walls 14*d*, trash and other debris can freely fall out of the hopper 14 and thereby not block the movement of golf balls therein.

Figure 2:
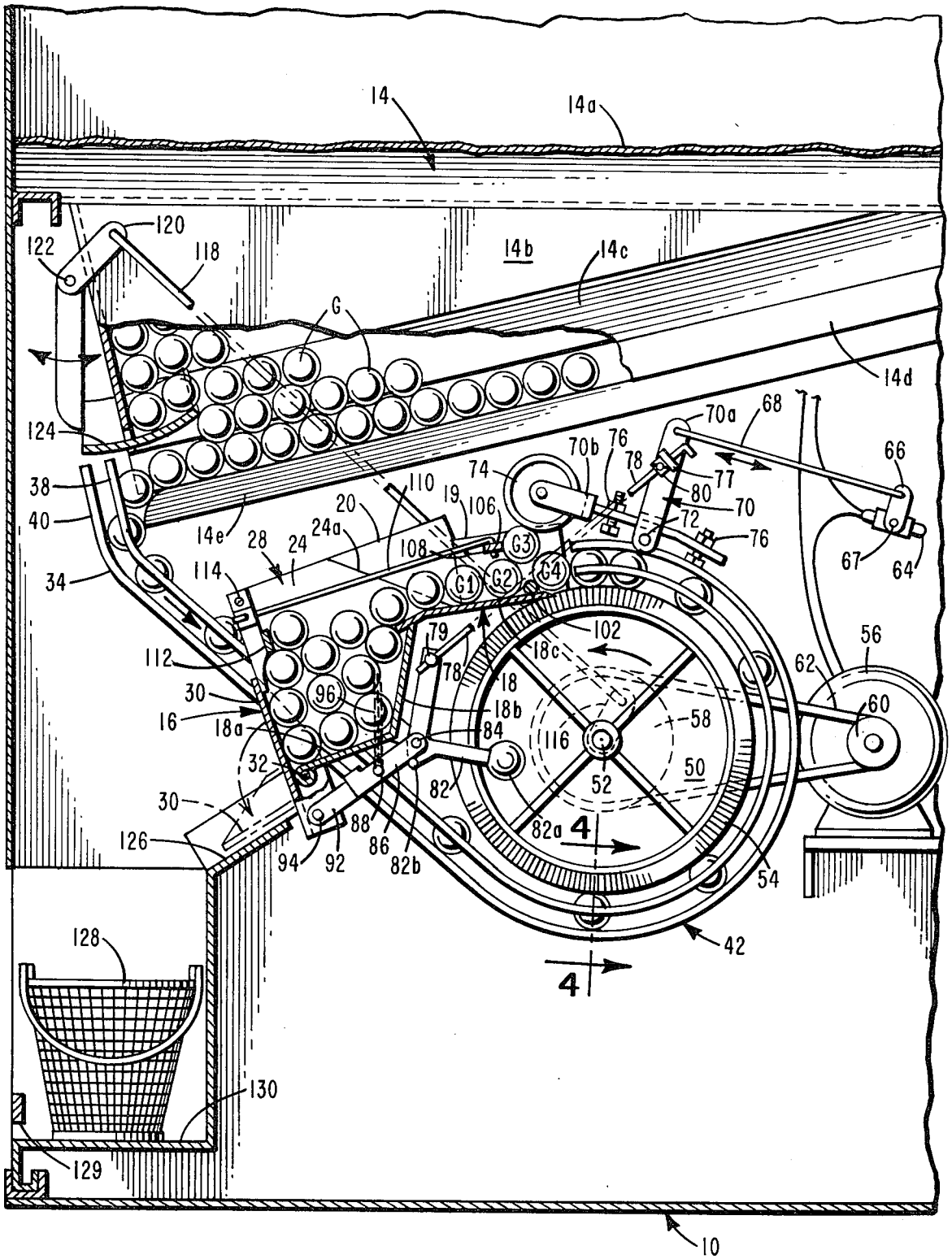
FIG. 2 is a cross-sectional view of the invention.
Figure 3:
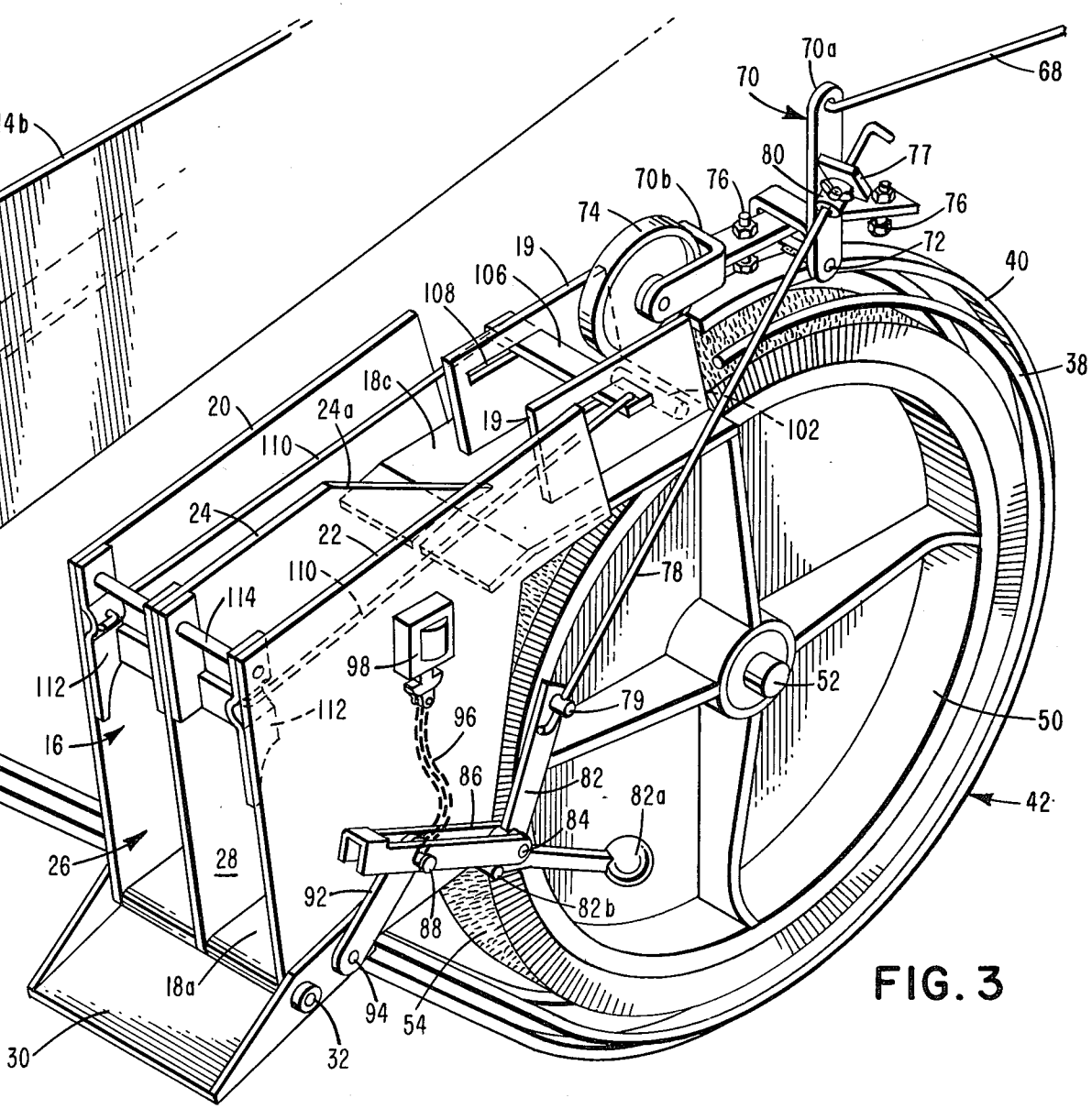
FIG. 3 is an enlarged perspective view of some of the parts shown in FIG.2.

Also fixedly secured within the housing 10 is a receptacle 16. With reference to FIGS. 2 and 3, the receptacle 16 includes a bottom wall 18, a pair of vertical sidewalls 20, 22 and a vertical partition 24, having a bevelled edge 24*a*, which divides the receptacle 16 into two bins 26, 28. Each bin is of a width slightly greater than the diameter of a golf ball. The bottom wall includes three sections 18*a*, 18*b* and 18*c* (FIG. 2). The receptacle 16 also includes a pair of short vertical side walls 19 which extend upwardly from the section 8*c*. The side walls 19 are spaced from each other by a distance slightly greater than the diameter of a golf ball and define with the section 18*c* a chute through which golf balls may move toward the partition 24. One side wall 19 is positioned substantially midway between the partition 24 and the side wall 20 and the other side wall 19 is positioned substantially midway between the partition 24 and the side wall 22. The receptacle is normally closed by a gate 30 which is pivotally mounted, by means of a pin 32, to the bottom of the receptacle 16. The gate 30 is normally counterweighted so that the portion thereof between the pin 32 and the bottom is heavier than the remainder thereof so that the gate is normally closed (solid line position of FIG. 2). As will subsequently appear, the receptacle 16 is constructed and has a predetermined volume to hold a predetermined number of golf balls for dispensing.

Figure 4:
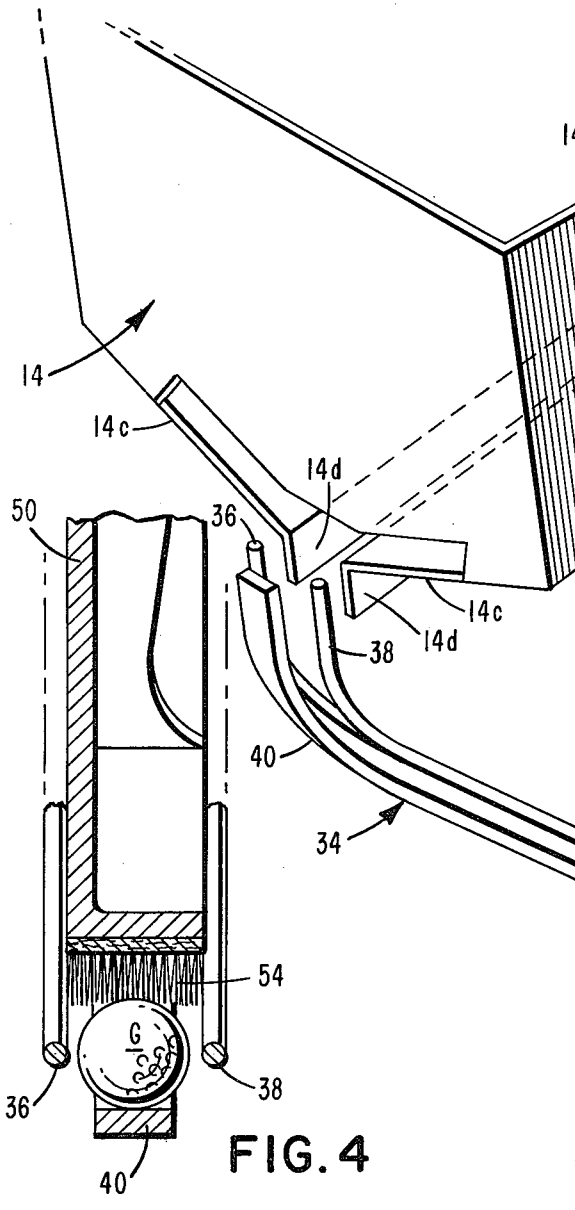
FIG. 4 is a cross-sectional view taken along line 4—4 of FIG. 2.

A channel-shaped passageway 34 is provided for guiding the golf balls from the hopper 14 to the receptacle 16. The passageway 34 is formed by a pair of side rods 36, 38 spaced transversely from each other by a distance slightly greater than the diameter of a golf ball (see FIG. 4) and below the side bars 36, 38. The side bars 36, 38 and the bar 40 may be fixedly secured to the walls of the housing 10 by brackets. Also, because of the spacing between the bar 40 and the side bars 36, 38, trash or other debris can readily fall between them and thereby not block the movement of golf balls in the passageway 34. The passageway 34 extends from one end of the hopper 14 and terminates in a substantially semi-circular portion 42 which is substantially concentric with but spaced radially outwardly from the circumferential periphery of a wheel 50 to be subsequently described. The semi-circular portion 42 terminates at the other end of the passageway which is adjacent the other end of the receptacle 16 at the uppermost portion of the wheel 50.

Fixedly secured to and rotatably mounted within the housing 10 is the wheel 50 which is rotatable about a substantially horizontally extending axle 52. The wheel 50 includes an outer resilient circumferential surface which is defined by a plurality of radially extending bristles 54. The bristles 54 may be made of a synthetic fiber, such as nylon. Upon rotation of the wheel 50 in a manner to be subsequently described, the golf balls in the semi-circular portion 42 are rolled by the bristles along the passageway 34 to the receptacle 16.

The wheel 50 is driven by an electric motor 56 through pulleys 58 and 60 and a belt 62 trained about the pulleys 58 and 60. As shown in FIG. 2, the motor 56 is connected to an electrical source, through an openable and closable switch, for example a mercury switch, 64. The switch 64 has an arm 66 pivotally mounted thereon about a pin 67. As viewed in FIG. 2, movement of the arm 66 toward the left or in a counterclockwise direction closes the switch whereas movement of the switch to the right or in the clockwise direction opens the switch. Pivotally connected to the end of the arm 66 is a link 68 which is pivotally connected to one leg 70*a* of a rocker arm 70 which is pivotally mounted on the other end of the passageway 34 by a pin 72. The other arm 70*b* of the rocker arm 70 is bifurcated and freely rotatably carries at its free end a roller 74. Movement of the rocker arm 70 is limited by means of a pair of adjustable stops 76, in the form of nuts and bolts, which can abut the passageway 34 and limit rocking movement of the rocker arm 70.

Fixedly secured to an intermediate portion of the leg 70*a* of the rocker arm 70 is an apertured plate 76. A link 78, in the form of a rod bent at one end, extends through the aperture in the plate 76. An abutment member 80 is disposed about the link 78 and is suitably secured thereto. The member 80 can be adjustably fixedly positioned along the link 80. The other end of the link 78 extends through and is fixedly secured to a pin 79. The link 78 is therefore pivotally connected by the pin 79 to the free end of one leg of a rocker arm 82. The other leg of the rocker arm 82 carries a weight 82*a* at its free end for a purpose to be subsequently described. The rocker arm 82 is pivotally connected by a pin 84 to a bracket on the receptacle 16 and to one end of a link 86 which is in turn pivotally connected through a pin 88 to another link 92 which is pivotally connected by a pin 94 to the lower end of the gate 30. The rocker arm 82 also has a projection 82*b* projecting therefrom which can abut the lower edge of the link 86.

The pin 88 projects from the link 86 and one end of a chain 96 is secured to the pin 88. The other end of the chain 96 is attached to a solenoid 98. Upon insertion of a sufficient monetary amount into a coin slot 100 (FIG. 1) which thereby closes a circuit in conventional manner, the solenoid 98 is actuated and pulls the chain 96 upwardly to open the gate 30 as will be subsequently described.

Adjacent the other end of the receptacle 16, i.e., the end opposite the gate 30, is a stop bar or rod 102 which is fixedly secured to the section 18*c* of the bottom 18 of the receptacle 16 and spaced below the roller 74 by a distance slightly greater than the diameter of a golf ball. Positioned above the bottom 18 on the upper end of the side walls 19 is a stop bar 106 which is slidable in a pair of grooves 108 defined in the side walls 19. The stop bar 106 is below the roller 74 and above the stop bar 102. One end of each of a pair of links 110 are secured to the opposite ends of the stop bar 106. The other end of the links 110 are pivotally connected to an arm assembly 112. The arm assembly 112 is fixedly secured to a pin 114 which is pivotally connected to the receptacle 16. The pin 114 extends through and is pivotable in apertures in the upper edge of the side walls 20, 22 and the partition 24 at the end thereof adjacent the gate 30. The arm assembly 112 normally projects downwardly and is partially coextensive as shown in FIG. 1 with the gate 30 when it is closed.

Secured to and rotatable with the wheel 50 about the axle 52 is a crank arm 116. One end of a link 118 is pivotally connected to the free end of the crank arm 116. The other end of the link 118 is pivotally connected to the free end of one leg of a rocker arm 120 which pivots about a pin 122 on a bracket secured to the hopper 14. Attached to the lower free end of the other leg of the rocker arm 120 is an agitator member 124 for agitating the golf balls G stored in the hopper 14. Upon rotation of the wheel 50, the crank arm 116 rotates therewith to effect reciprocation of the link 118, rocker arm 120 and agitating member 124. Such reciprocation of the agitating member 124 prevents the golf balls in the hopper 124 from bridging across the channel defined between the walls 14*d.*

The housing 10 also includes a recessed shelf 130, open at the top and front, on which may be positioned a bucket or basket 128 to receive the golf balls G to be dispensed from the receptacle 16. To ensure proper discharge of the balls G into the basket or bucket 128 a chute 126 may be provided. The chute 126 extends upwardly from the back wall of the shelf 130 (FIG. 2) and forms a continuation of the gate 30 when open. Additionally, a bar 129 may be secured to the housing 10 across the open front of the recessed shelf 130. The bar 129 will retain the golf balls G on the shelf 130 when dispensed from the receptacle 16 in the event the basket or bucket 128 is not in position on the shelf 130.

Assuming the hopper 14 has been filled with golf balls, the operation of the invention will be described. In operation, the golf balls G stored in the hopper 14 will gravitate to the bottom of the hopper 14 and roll by gravity along the bar 14*e* into the passageway 34 and gravitate to the lower end thereof. Upon rotation of the wheel 50, the agitator member 124 is reciprocated in the hopper 14 and the balls will be rolled through the passageway 34, including the semi-circular position 42, by the bristles 54 on the wheel 50 to the uppermost end thereof. From their exit from the other end of the passageway 34 at the top of the wheel 50, each ball will continue to roll against the stop bar 120 and be pushed over the stop bar 102 by the following ball and then move downwardly through the passageway defined between the side walls 19 and and contact the bevelled edge 24*a* of the partition 24 and roll right or left into either of the bins 26 and 28. Upon continued rotation of the wheel 50, the balls G will continue to fill both of the bins 26 and 28 since the gate 30 is closed. After one bin is full, subsequent balls will continue to fill the other bin until both bins are full, at which time a ball G1 remains, as shown in FIG. 2, behind the bevelled edge 24*a* and between the walls 19. Further movement of the ball G1 is prevented by the balls already in the bins 26 and 28. The next ball G2 will also come to a stop in the channel between the side walls 19 and be blocked from further movement by the ball G1. With further rotation of the wheel 50, the next ball G3 coming from the passageway 34 will be deflected upward over the stop bar 102 by the next ball G4 and the following balls and abut the stop bar 106. The bar 106 cannot move in the slots 108 because the links 110 and the arm assembly 112 cannot move because the arm assembly 112 is held stationary by the closed gate 30. Upon moving upwardly into its FIG. 2 position, the ball G3 contacts the roller 74 and pivots the rocker arm 70 clockwise about the pin 72 to thereby move the link 68 and arm 66 to the right to open the switch 64 and thereby stop rotation of wheel 50. As shown in FIG. 2, the receptacle 16 is now ready to dispense 29 golf balls, i.e., 13 balls in each of the bins 26 and 28 on each side of the partition 24, and the balls G1, G2 and G3. With the receptacle 16 ready to dispense a predetermined number of golf balls, one complete cycle of operation will be described.

When one desires to dispense the balls from the receptacle 16, he inserts the required monetary amount through the coin slot 100. The coin or coins once inserted close an electrical circuit in conventional manner and actuate the solenoid 98. Such actuation lifts the chain 96 and moves the links 86 and 92 upwardly into the position shown in FIG. 3. Immediately thereafter the coin drops through the coin box, the circuit opens, the solenoid 98 is deactivated, and the chain 96 is slackened as shown in FIG. 3. The initial lifting of the chain 96 and upward movement of the links 86 and 92 pivots the gate 30 downwardly about the pin 32 to open the gate 30, as shown in FIG. 2, so that the balls G are dispensed from the receptacle 16 down the chute 126 into the bucket or basket 128. Upon opening of the gate 30, the arm assembly 112 swings downwardly, by its own weight and the force of the ball G3 and following balls on the stop bar 106, and the links 110 are moved to the left, as viewed in FIG. 2, with the stop bar 106 to also release the ball G3. The balls G1, G2 and G3 will contact the bevelled portion 24*a* and roll into either of the bins 26 or 28 and be discharged over the gate 30. As the ball G3 moves further downwardly into the receptacle 16 for dispensing over the gate 30, the roller 74 would normally fall by its own weight to close the switch 64, through the rocker arm 70, the link 68, and the arm 66, to rotate the wheel 50. However, when the gate 30 moves to its open position, the links 86 and 92 move upwardly, the projection 82*b* on the rocker arm 82 follows the link 86 and the weight 82 further causes clockwise pivoting of the rocker 82 to move the link 78 upwardly and to the right, as viewed in FIGS. 2 and 3, so that the abutment member 80 abuts the plate 76 and holds it in the FIG. 2 position or moves it and rocker arm 70 counterclockwise about the pins 70. Such holding or movement keeps the switch 64 open. As a result, the wheel 50 is not rotated by the motor 56 when the gate 30 is open so that additional golf balls, such as G4, cannot be conveyed into the receptacle 16. After all balls in the receptacle 16 have been discharged and run over the gate 30, the counterweighting of the gate 30 causes it to pivot clockwise, as veiwed in FIG. 2, back to its original closed position. Upon closing, the upper end of the gate 30 strikes the arm assembly 112 and moves it to the right as viewed in FIG. 2 together with the links 110 and the stop bar 106. The gate 30, the arm assembly 112, the links 110, and the stop bar 106 have now returned to their original position so that the receptacle 16 is now ready to receive another group of balls. Upon closing of the gate, the chain 96, links 92 and 86, the rocker arm 82, and the link 78 return to their original positions. The link 78 and the abutment member 80 thereon move downwardly and to the left as received in FIGS. 2 and 3. As a result, the weight of the roller 74 pivots the rocker arm 70 about the pin 72 and moves the arm 66 in a counterclockwise direction to close the switch 64 and connect an electrical source to the motor 56. As a result, the motor 56 rotates the wheel 50 through the belt 62, causing simultaneous reciprocation of the agitating member 124 in the hopper 14, and the bristles 54 of the wheel 50 roll golf balls through the passageway 34 into the receptacle 16 over the stop 102 until such time as the receptacle 16 is full. At that time, another ball G3 will ride up on another ball G2 and move the roller 74 upwardly to pivot the rocker arm 70 clockwise about the pin 72 and move the arm 66 in a clockwise direction to open the switch 64 and cut off power to the motor 56. As a result, the wheel 50 stops rotating and further balls are not fed toward the receptacle 16. At this time, the receptacle is full of the desired predetermined number of balls and ready for subsequent actuation and dispensing of the predetermined number of golf balls.

What is claimed is:

1. An apparatus for dispensing golf balls comprising:

a hopper for storing golf balls;

a receptacle for retaining a predetermined number of golf balls in position for dispensing, said receptacle having an openable and closable gate normally closing one end thereof;

means for guiding and conveying golf balls from the hopper to the receptacle, said guiding and conveying means comprising:

a wheel rotatable about a substantially horizontal axis and having a resilient outer circumferential surface, and a passageway of a width slightly greater than the diameter of a golf ball, one end of said passageway being adjacent the hopper and the other end thereof being adjacent the receptacle, said passageway terminating in an at least part-circular portion substantially concentric with the wheel periphery, said at least part-circular portion terminating at the other end of the passageway adjacent the uppermost portion of the wheel and having a bottom spaced from the wheel periphery by a distance slightly less than the diameter of a golf ball, and means for rotating said wheel to refill said receptacle until a predetermined number of golf balls are in said receptacle after said gate is closed after discharge of golf balls therefrom.

2. An apparatus for dispensing golf balls as claimed in claim 1, wherein:

said receptacle is of a predetermined volume for retaining the predetermined number of golf balls for dispensing.

3. An apparatus fo dispensing golf balls as claimed in claim 2, wherein said receptacle is open at the other end thereof adjacent the other end of the passageway and comprises:

a bottom, a pair of vertical side walls, and a vertical partition between said side walls which divides the receptacle into first and second bins, each of which is of a width slightly greater than the diameter of a golf ball.

4. An apparatus for dispensing golf balls as claimed in claim 1, wherein:

said means for rotating said wheel comprises:

a motor drivingly connected to said wheel, an openable and closable switch for connecting said motor to an electrical source, first means connected to said switch for normally closing said switch to cause rotation of said wheel, said first means being actuated by the last golf ball filling said receptacle to open said switch when the predetermined number of golf balls are in said receptacle to stop rotation of said wheel, and second means connecting said gate to said switch to open same when said gate is open, said second means overriding said first means when said gate is open.

5. An apparatus for dispensing golf balls as claimed in claim 4, wherein:

said first means comprises:

a rocker arm pivotally connected to the passageway adjacent the other end thereof, a roller freely rotatably mounted on the free end of one leg of the rocker arm, said roller being positioned adjacent and above the other end of the passageway, and a first link, one end of which is connected to said switch and the other end of which is connected to the free end of the other leg of the rocker arm, and said second means comprises:

linkage means, one end of which is pivotally connected to the lower end of said gate, and the other end of which is connected to the other leg of the rocker arm.

6. An apparatus for dispensing golf balls as claimed in claim 5, further comprising:

an apertured plate fixedly secured to the other leg of the rocker arm, and said linkage means comprises a second link which extends through the aperture in the plate, said second link having an adjustable abutment member releasably secured thereon and adapted to abut said plate whereby when said gate is opened said second link is moved and said abutment member abuts said plate to move said plate and said rocker arm and open said switch.

7. An apparatus for dispensing golf balls as claimed in claim 6, wherein:

said receptacle has a bottom, said gate is pivotally mounted intermediate its upper and lower ends to the bottom of the receptacle, and said linkage means comprises a third link pivotally connected at one end to the lower end of the gate, the other end of said third link being connected to said second link.

8. An apparatus as claimed in claim 7, further comprising:

a stop rod fixedly secured to and adjacent the lower end of the other end of the receptacle for blocking passage of golf balls from the other end of the passageway when the wheel is not rotating, said stop rod being pasitioned beneath said roller and spaced therefrom by a distance slightly greater than the diameter of a golf ball, and a stop bar slidable in the upper end of the other end of the receptacle, said stop bar being adapted to block movement of the last golf ball filling said receptacle and being slidable toward said gate when it opens to release the last golf ball, said stop bar below said roller and above said stop rod.

9. An apparatus for dispensing golf balls as claimed in claim 8, further comprising:

an arm pivotally connected to the upper end of the one end of said receptacle, said arm being blocked against movement toward said gate by the upper end of said gate when closed but being so movable upon opening of said gate, and a fourth link, one end of which is connected to said arm and the other end of which is connected to said stop bar whereby when said gate is opened said plate moves toward said gate and moves said fourth link and said stop bar therewith so that the last ball may also be discharged from the receptacle.

10. An apparatus for dispensing golf balls as claimed in claim 7, wherein:

said linkage means further comprising:

a fourth link, the other end of said third link being pivotally connected to an intermediate portion of said fourth link, and a second rocker arm, said second rocker arm and one end of said fourth link being pivotable about the same axis, the free end of one leg of said second rocker arm being weighted and the free end of the other leg thereof being pivotally connected to one end of said second link, said second rocker arm having a projection thereon adjacent the intersection of the legs thereof which is abuttable with said fourth link.

11. An apparatus for dispensing golf balls as claimed in claim 1, wherein:

said wheel has a plurality of substantially radially extending bristles extending circumferentially thereabout which define the resilient outer circumferential surface thereof.

12. An apparatus as claimed in claim 1, further comprising:

means for opening said gate, said opening means comprising:

a link pivotally connected to the lower end of said gate, and a chain connected to said link whereby when said chain is pulled, said link is moved to open said gate.

13. An apparatus as claimed in claim 1, wherein:

said passageway comprises a pair of side rods spaced transversely from each other by a distance slightly greater than the diameter of a golf ball and a bottom bar spaced from and centrally disposed between and beneath said side rods.

14. An apparatus for dispensing golf balls as claimed in claim 1, further comprising:

means for agitating golf balls in said hopper to ensure their ready flow therefrom into said passageway.

15. An apparatus for dispensing golf balls as claimed in claim 14, wherein:

said hopper has a bottom comprising two side surfaces which slope downwardly toward each other and toward one end thereof adjacent said one end of said passageway so that golf balls in said hopper will gravitate toward said passageway.

16. An apparatus for dispensing golf balls as claimed in claim 15, wherein each of said side surfaces terminate at edges spaced from each other by a distance slightly greater than the diameter of a golf ball, said hopper further comprises:

a vertical wall which extends downwardly from said edges; and a guide bar centrally disposed in said channel adjacent the bottom of the vertical walls to define a channel therewith, said guide bar and said vertical walls also sloping toward the one end of the hopper adjacent the one end of the passageway.

17. An apparatus for dispensing golf balls as claimed in claim 14, wherein:

said agitating means comprises a reciprocable arm in said hopper, said arm being drivingly connected to said wheel so as to reciprocate upon rotation of said wheel.

18. An apparatus for dispensing golf balls comprising:

a hopper for storing golf balls;

a receptacle for retaining a predetermined number of golf balls in position for dispensing, said receptacle comprising:

a bottom, a pair of vertical side walls, a vertical partition between said side walls which divides the receptacle into first and second bins, each of which is of a width slightly greater than the diameter of a golf ball, and an openable and closable gate closing on end of the receptacle;

means for guiding and conveying golf balls from the hopper to the receptacle, said guiding and conveying means comprising:

a channel shaped guideway, one end of which is adjacent the hopper and the other end of which is adjacent the receptacle, and a wheel rotatable about a horizontal axis, said wheel having radially extending bristles on the circumferential periphery thereof;

said channel shaped guideway being of a width slightly greater than the diameter of a golf ball and terminating in at least semi-circular portion substantially concentric with the wheel periphery, said at least semi-circular portion terminating at the other end of the passageway adjacent the uppermost portion of the wheel and having a bottom spaced from the wheel periphery by a distance slightly less than the diameter of a golf ball;

means for rotating said wheel to refill said receptacle until a predtermined number of golf balls are in said receptacle after said gate is closed after discharging golf balls from said receptacle.

19. An apparatus for dispensing golf balls as claimed in claim 18, wherein:

said means for rotating said wheel comprises:

a motor drivingly connected to said wheel, an openable and closable switch for connecting said motor to an electrical source;

first means connected to said switch for normally closing said switch to cause rotation of said wheel, said first means being actuated by the last golf ball filling said receptacle to open said switch when the predetermined number of golf balls are in said receptacle to stop rotation of said wheel, second means connecting said gate to said switch to open same when said gate is open, said second means overriding said first means when said gate is open.

* * * * *